US006401972B1

(12) United States Patent
Schlattl et al.

(10) Patent No.: US 6,401,972 B1
(45) Date of Patent: Jun. 11, 2002

(54) RESTROOM DISPENSER

(75) Inventors: Alice Schlattl; Oliver Schlattl; Bettina Dichtl, all of Ruderting (DE)

(73) Assignee: Cetoni Umwelttechnologie-Entwicklungs-GmbH, Passau (DE)

( * ) Notice: Subject to any disclaimer, the term of this patent is extended or adjusted under 35 U.S.C. 154(b) by 0 days.

(21) Appl. No.: 09/525,134

(22) Filed: Mar. 14, 2000

(51) Int. Cl.[7] ..... A97F 1/00
(52) U.S. Cl. ..... 221/96; 222/192
(58) Field of Search ..... 221/92, 96, 199; 222/192; 312/209, 229; 401/213, 216, 214

(56) References Cited

U.S. PATENT DOCUMENTS 3,331,533 A * 7/1967 Krugger ..... 221/96
4,548,340 A * 10/1985 Messer ..... 222/135
5,186,360 A * 2/1993 Mease et al. ..... 222/63
5,706,986 A * 1/1998 Brandenburg et al. ..... 222/192

* cited by examiner

*Primary Examiner*—Kenneth W. Noland
(74) *Attorney, Agent, or Firm*—Hoffman, Wasson & Gitler, PC

(57) ABSTRACT

The invention pertains to a new type of restroom dispenser and is characterized by a casing, the back wall of which can be fastened to a vertical surface such as a restroom wall and which forms an inner chamber that holds a tank of a liquid dispenser, which has a dosing apparatus on the bottom of the casing for dosed dispensing of a liquid, for example a cleansing liquid, for example onto a piece of toilet paper.

12 Claims, 11 Drawing Sheets

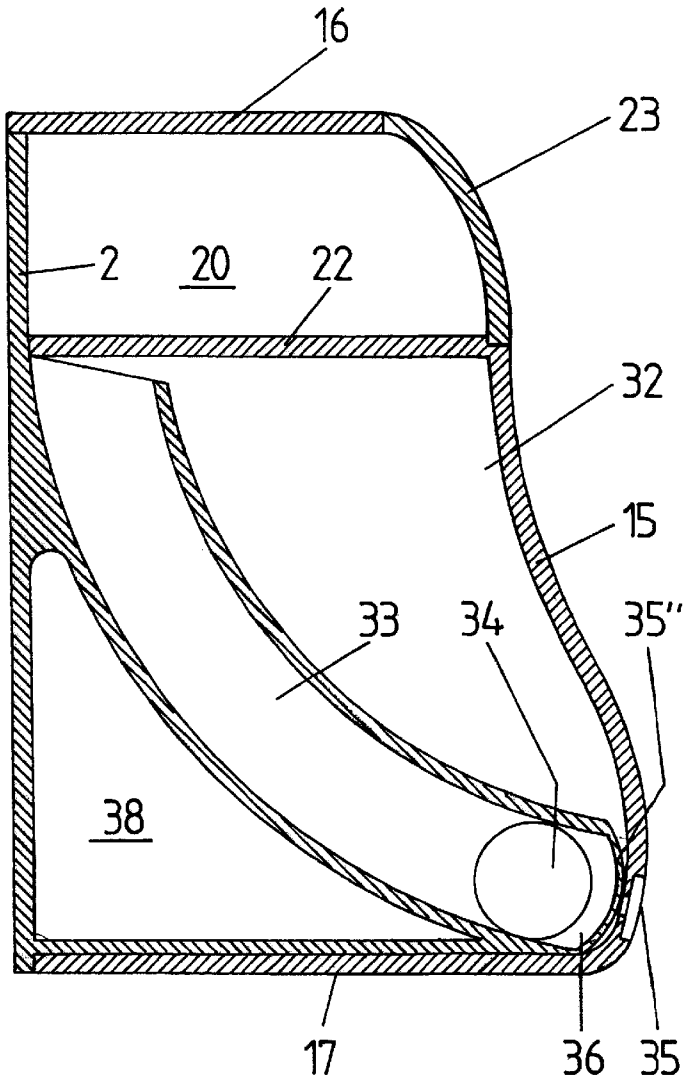
Fig.6
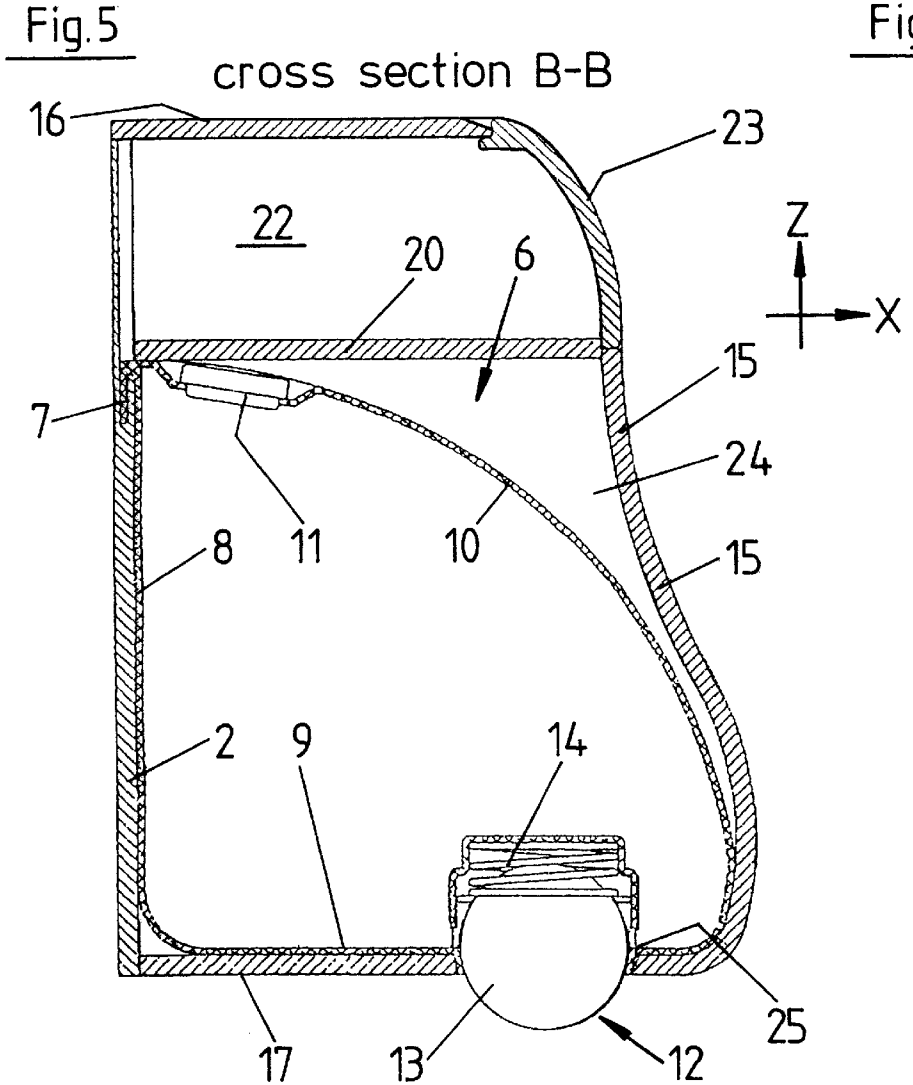
Fig.5 cross section B-B cross section E-E

Z
X
34
33
38
2

Z
Y
G
2
5
F
5

33
5
2

G
F 26
27
28
28'
29
31

RESTROOM DISPENSER

BACKGROUND OF THE INVENTION

The invention pertains to a restroom dispenser.

The object of the invention is to present a dispenser that is suitable as a supplementary element for restrooms, as a liquid dispenser for moistening paper, especially toilet paper, and for additional hygiene of the genital area.

SUMMARY OF THE INVENTION

A suitable dosing device for the liquid dispenser is, for example, a roller, which is provided with a ball and is of a similar to design to a deodorant roller. Suitable dosing devices are also spray mechanisms or other dispensers that enable dosed dispensing of liquids, for example, membrane dispensers.

In a preferred embodiment of the invention, the restroom dispenser also has a tampon dispensing device, and/or a fragrance dispenser, and/or an air freshener, and/or at least one lockable compartment in which additional objects, especially sanitary napkins and panty liners can be stored. In a preferred embodiment of the invention, the casing is formed in such a way that it has a back wall, or an installation element by which the dispenser can be fastened to a vertical surface, for example, to the surface of a restroom wall, and has a hood-shaped casing that is hinged on the back wall, so that by moving away the hood-shaped casing the dispenser can be opened and by moving back the hood-shaped casing the dispenser can be closed.

The actual dispensing method, i.e. the elements and specifically the tank of the liquid dispenser are located on the back wall, so that these parts can easily be refilled and/or replaced when the casing is open.

The size and shape of the dispenser are such that they match visually, the existing paper roll dispensers.

In a further possible embodiment of the invention, the dispenser has a modular construction, i.e. it consists of several modules, each of which is fully functional in itself, i.e. for example, a liquid dispenser module, a fragrance dispenser or an air freshener module and/or a tampon dispenser module. The modules, or their casings, can then be connected to each other.

In a further possible embodiment of the invention, the dispenser is constructed in such a way that the casing is hood-shaped and can be moved away from the back wall for opening, and that means of fastening the liquid dispenser tank are provided on the back wall.

In a further possible embodiment of the invention, the dispenser is constructed in such a way that the hood-shaped casing can swivel on an axis, preferably on the vertical axis on the back wall.

In a further possible embodiment of the invention, the dispenser is constructed in such a way that the dosing device of the liquid dispenser includes a roller, for example, a roller provided with a ball.

In a further possible embodiment of the invention, the dispenser has a tampon dispensing device in the casing.

In a further possible embodiment of the invention, the dispenser is constructed in such a way that the tampon dispensing device includes a shaft for holding a number of tampons and at least one dispenser slide mechanism on the one open end of the shaft.

In a further possible embodiment of the invention, the dispenser is constructed in such a way that the shaft is located on the back wall.

In a further possible embodiment of the invention, the dispenser has a fragrance dispenser and/or an air freshener dispenser, in the casing.

In a further possible embodiment of the invention, the dispenser is constructed in such a way that the fragrance dispenser has a spraying device with an actuating button, that is accessible on the outer surface, preferably on the front of the casing.

In a further possible embodiment of the invention, the dispenser is constructed in such a way that the spraying device of the fragrance dispenser is located on a tank of the fragrance dispenser.

In a further possible embodiment of the invention, the dispenser is constructed in such a way that the casing forms at lest one compartment for holding other objects.

In a further possible embodiment of the invention, the dispenser is constructed in such a way that the compartment is closed by a hinged cover on the front.

In a further possible embodiment of the invention, the dispenser is constructed in such a way that the dosing device of the liquid dispenser includes a dosing pump and a dosing aperture, connected with the outlet of this pump, or forming the outlet of this pump.

In a further possible embodiment of the invention, the dispenser is constructed in such a way that the dosing pump can be actuated manually by means of an actuating element, preferably by means of a ring-shaped actuating element.

In a further possible embodiment of the invention, the dispenser is constructed in such a way that the actuating element is located on the bottom of the dispenser casing.

In principle, the possibility also exists of integrating the common paper roll dispenser in the dispenser, or of constructing it as a module for such a dispenser.

BRIEF DESCRIPTION OF THE DRAWINGS

The following invention is described in more detail with reference to the sample embodiments in the figures. These depict:

FIG. 6 a cross section corresponding to the line C—C of FIG. 4;

DETAILED DESCRIPTION OF THE INVENTION

Figure 1:
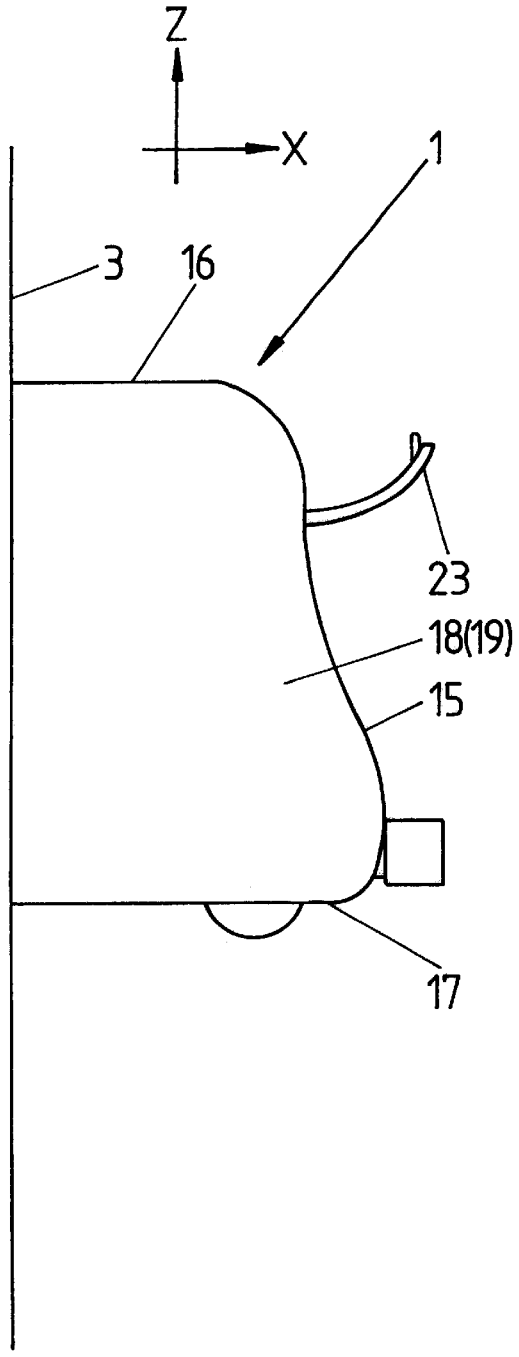
FIG. 1 the restroom dispenser of the invention fastened to a vertical wall in side view.
Figure 2:
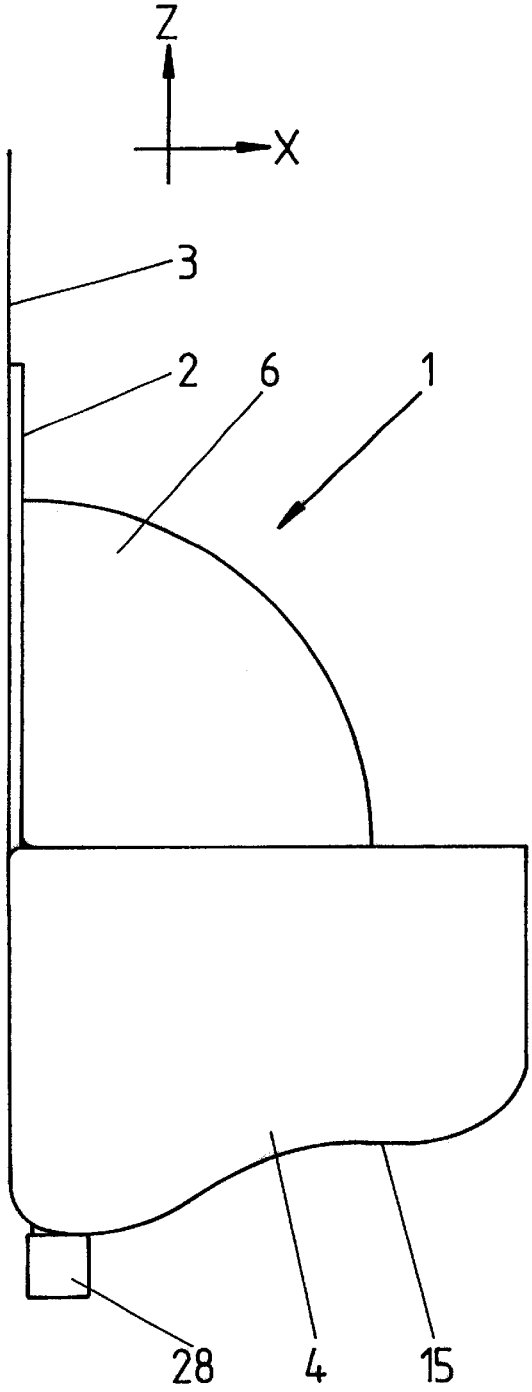
FIG. 2 a depiction similar to FIG. 1, however with the dispenser open.
Figure 3:
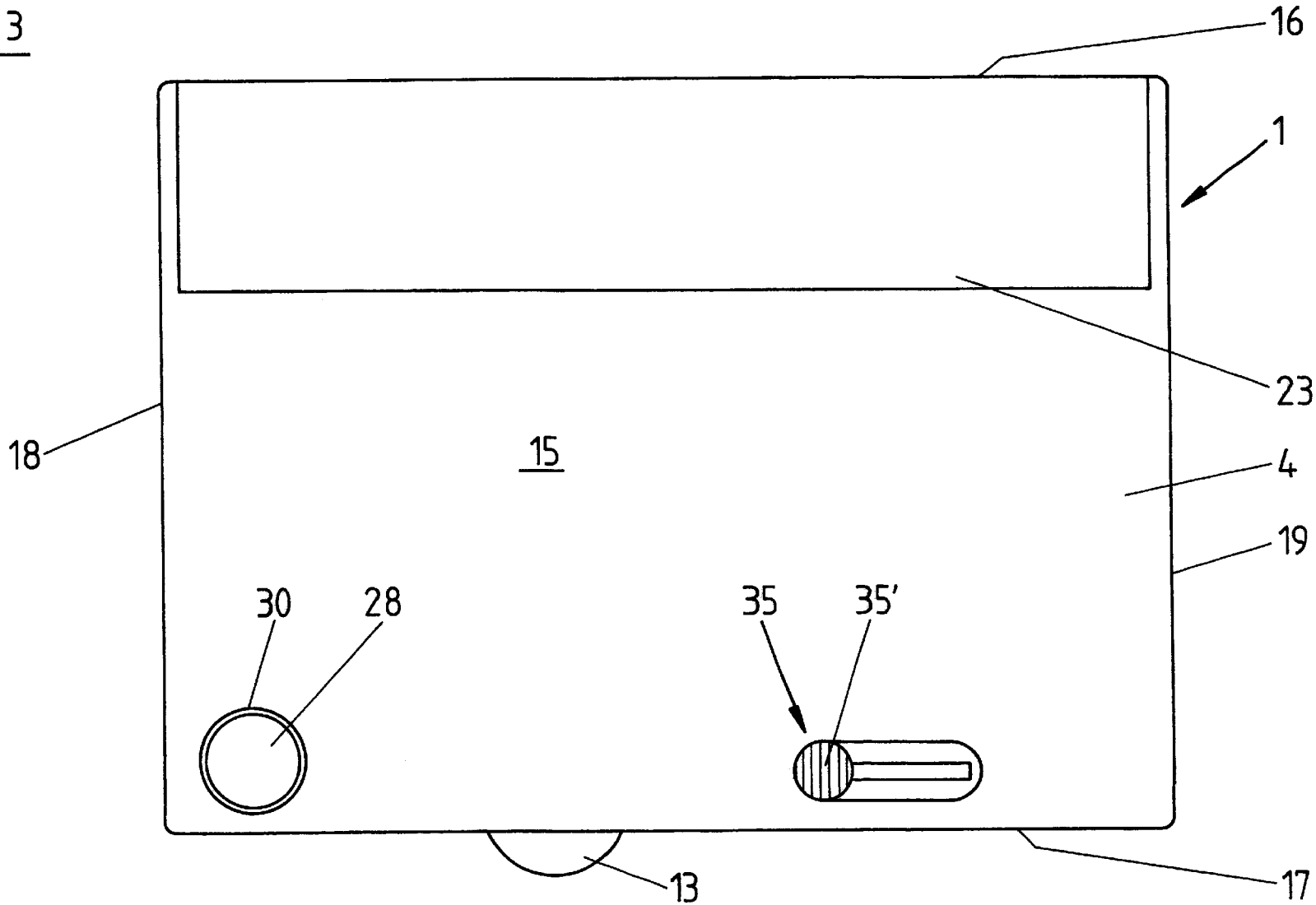
FIG. 3 a front view of the dispenser of FIG. 1.

The dispenser 1 depicted in the Figures, contains an installation plate or back wall 2, with which the dispenser 1 can be fastened to a vertical restroom wall 3, by gluing with suitable adhesives, e.g. a double-sided adhesive strip, or with the help of fastening elements, such as screws. The dispenser 1 serves as a supplementary element for restrooms that is installed in addition to the already existing paper roll dispensers. The outer appearance of the dispenser 1 or of the casing located on the back wall 2, is adapted to the design of common paper roll dispensers.

For the sake of clarity, the three right-angled spatial axes are designated with X, Y and Z, of which the Y-axis and the Z-axis define the vertical surface of the restroom wall as Y-Z plane. The casing 4, which as the back wall 2 is made of a suitable, highly shock-resistant plastic, can be swiveled on the Y-axis on the lower edge of the essentially rectangular back wall 2 in the direction of the Y-axis, from the operating position depicted in FIG. 1 with the casing closed into a position in which the interior 5 of casing is opened, especially for the purpose of refilling, as described in more detail below.

Figures 10, 11, 12:
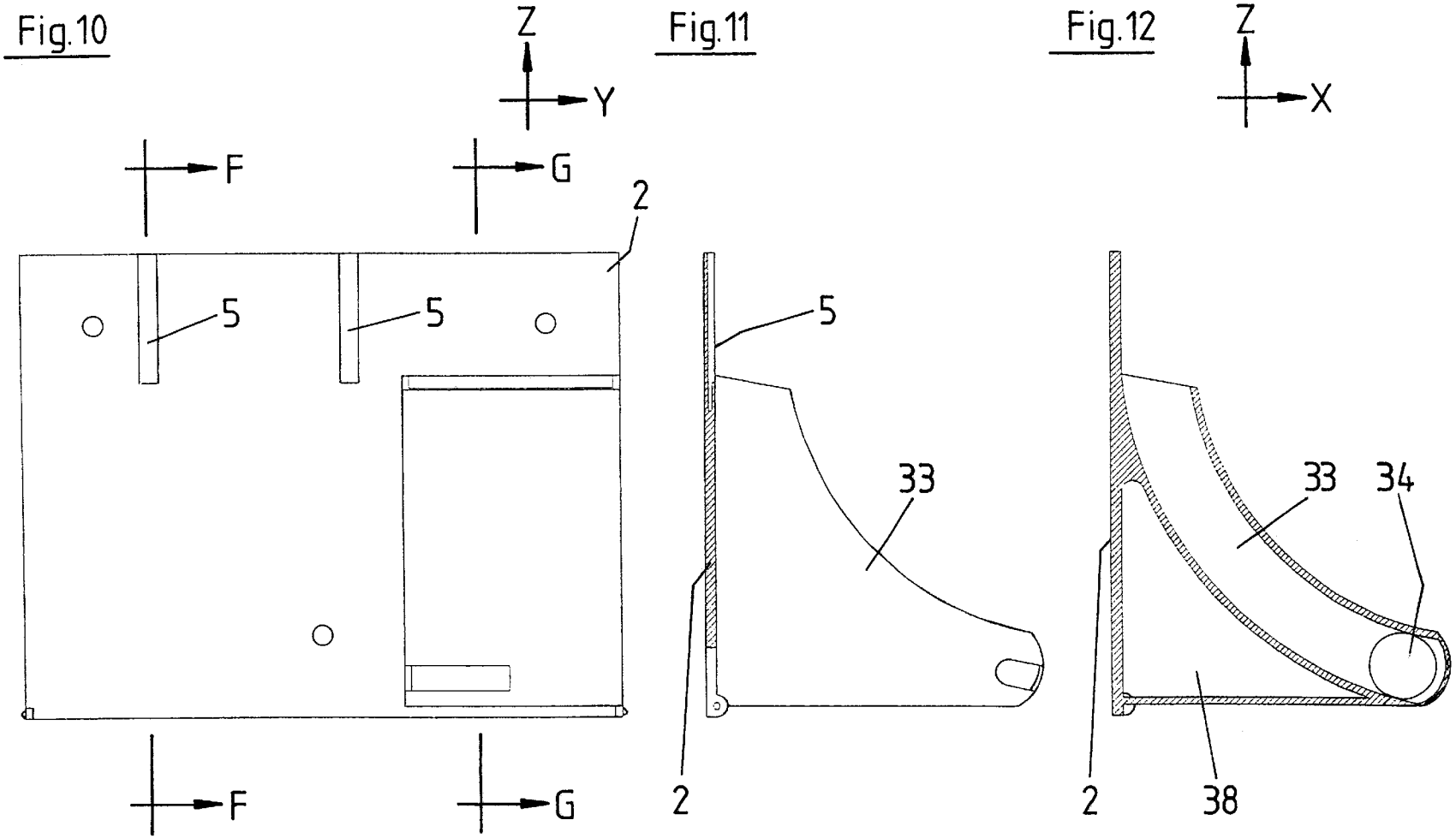
FIG. 10 a top view of the back wall or installation wall of the dispenser to be fastened to the vertical wall FIG. 11 a cross section corresponding to the line F—F of FIG. 10.
FIG. 12 a cross section corresponding to the line G—G of FIG. 11.
Figure 14:
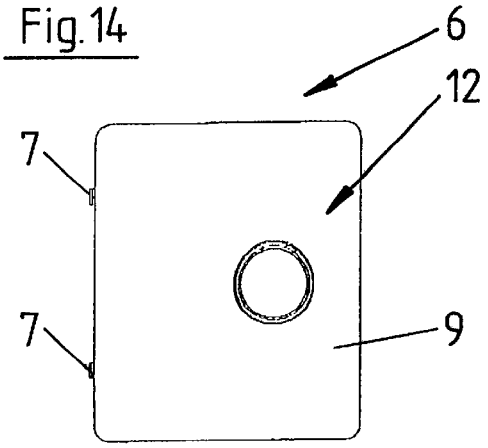
FIGS. 13–17 the tank of the liquid dispenser in back view, in bottom view, in side view and cross section, in top view and in front view.
Figure 17:
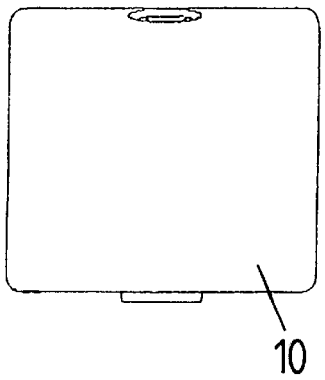
Figure 15:
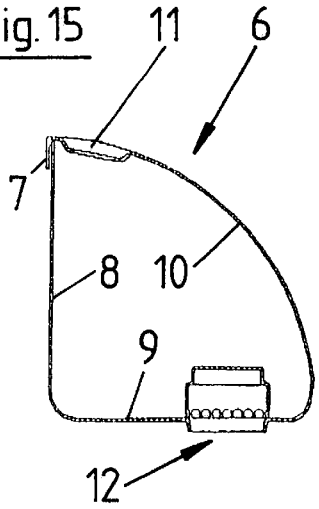
Figure 13:
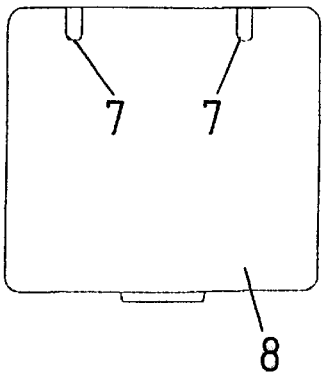
Figure 16:
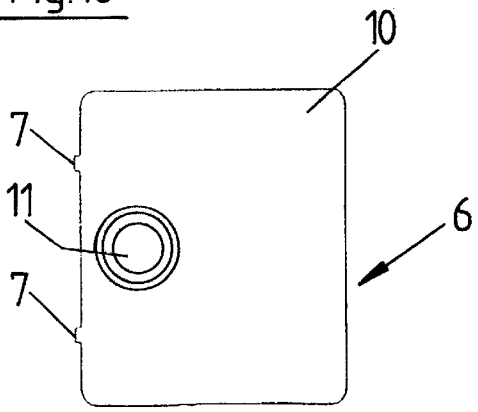
Figures 18, 19, 20, 21, 22:
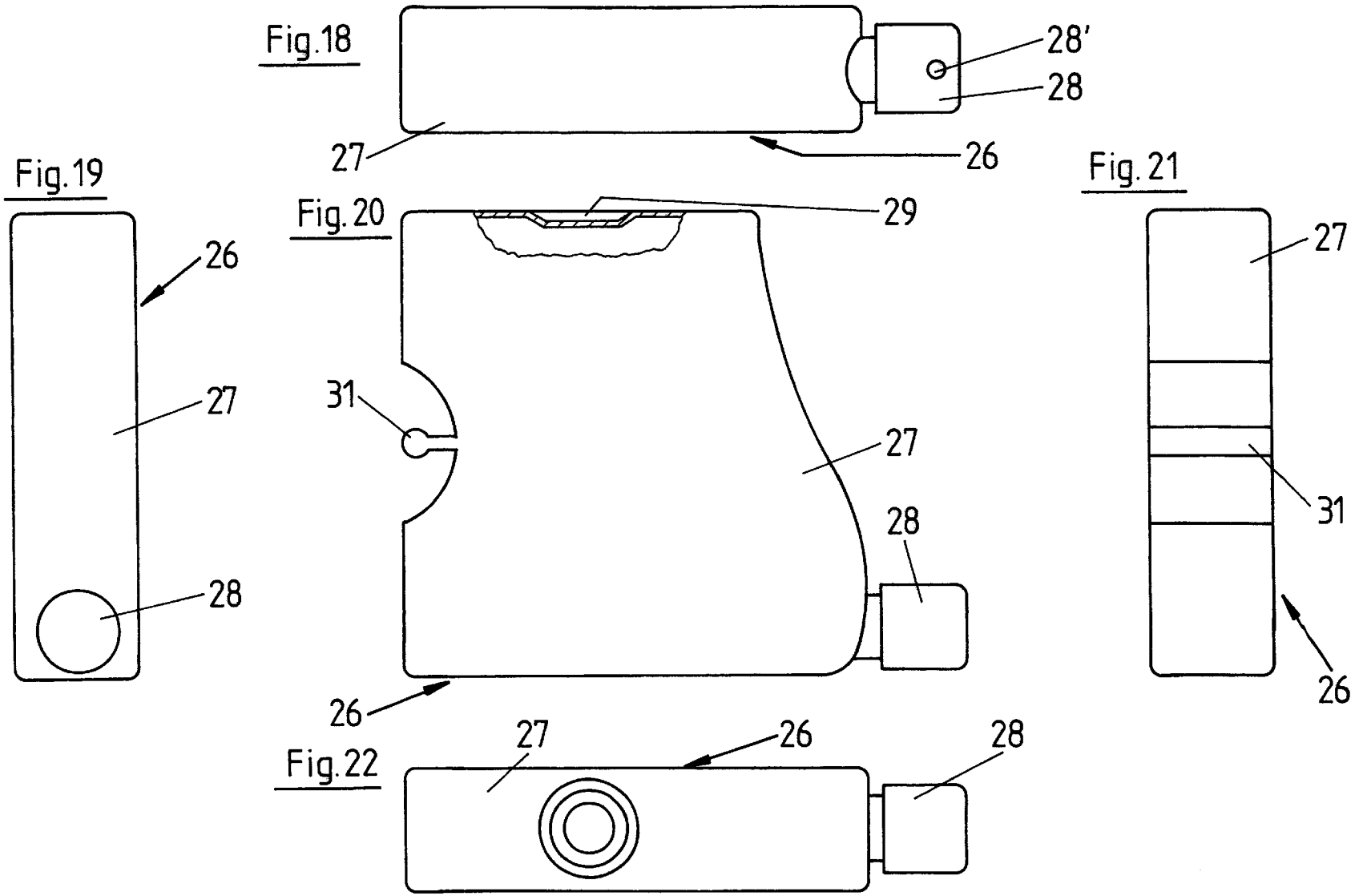
FIGS. 18–22 the fragrance dispenser in bottom view, front view, side view, back view and top view.

On the back wall 2, two receptacles are formed in the direction of the Y-axis offset against each other (especially FIGS. 10 and 11), into which a liquid dispenser tank 6 can be inserted from above by means of hook-like fastening elements 7 on the back of this tank when the casing is open, as depicted for example in FIG. 5. The receptacles 5 are both formed by groove-like recesses that are open on the front of the back wall 2 opposite of the building wall 3 and extend in the direction of the Y-axis. Each groove forms an undercut at its end, into which the hood-shaped fastening element 7 on the back 8 of the liquid dispenser tank 6 can be inserted. The fastening elements are on the upper edge of the back 8 of the liquid dispenser tank 6 extending in the direction of the Y-axis after insertion of the liquid dispenser tank 6.

In the cross-sectional plane, perpendicular to the back wall 2, i.e. in the X-Z plane, the liquid dispenser tank 6 has a profile corresponding to a quarter-circle segment, with an even back 8 and even bottom 9, which lies in the X-Y plane and extends perpendicular to the back 8, as well as a front 10 with a convex circular arc curvature on the outside.

A closable refill opening 11 is provided on the front 10 near the crossover to the back wall 8. On the other side 9, there is a dispenser or dosing device 12, which in the depicted embodiment includes a ball 13, located at an opening of the liquid dispenser tank 6, that is pressed against an inner surface of this opening by a pressure spring 14 in such a way that a tight seal is achieved. By holding a piece of toilet paper against the ball 13 and applying light pressure to this ball while rolling away it is possible to apply the liquid from the liquid dispenser tank 6 evenly onto the toilet paper for cleansing purposes.

As shown in the Figures, the casing 4 has a front wall 15 in the approximate shape of an S-curve, an upper wall 16 that lies in the X-Y plane when the casing is closed, a lower wall 17 that also lies in the X-Y plane when the casing is closed, and two side walls 18 and 19 that lie in the X-Z plane. Furthermore, the hood-shaped casing 4, that is open at the back, is provided with two intermediate walls 20 and 21, of which the intermediate wall 21 is parallel to the walls 16 and 17 and forms a compartment 22 below the upper wall 16 for holding various objects, such as panty liners, sanitary napkins, etc and which is closed on the front 15 of the casing 4 by a hinged cover 23, which, as the compartment 22, also extends along the entire width of the casing 4 in the direction of the Y-axis, and can be moved on the Y-axis on its bottom edge extending in the direction of the Y-axis, from a closed position, in which the hinged cover 23 locks into position on the upper edge on the top 16 of the casing 4, into an open position in which the hinged cover 23 extends past the front 15 of the casing, angled slightly upward, as depicted in FIG. 1, so that the concave inner side of the hinged cover 23 forms a removal recess. The hinged cover 23 is adapted to the shape of the front 15 of the casing 4. Between the left side wall 18, in FIG. 4, for example, and the intermediate walls 20 and 21, of which the intermediate wall 21 lies in the X-Z plane, and the bottom 17 a compartment 24 is formed in the casing 4 that holds e.g. the liquid dispenser tank 6 after closing the casing 4, in such a way that only part of the surface of the ball 13 extends to the outside through an opening 25 that is located in the bottom 17 of the casing 4. With a liquid dispenser tank 6, inserted, or attached to the back wall 2, as described above, a space remains in the closed casing 4 between this tank and the side wall 18 in the compartment 24 that is occupied by a fragrance dispenser 26 or by the tank 27 of this fragrance dispenser.

As already mentioned, the fragrance dispenser consists in part of the tank 27 for holding a liquid fragrance (e.g. perfume). On the front of the tank 27, there is a push button 28, with a nozzle opening 28' of a spray device, which is located in the tank 27 and is constructed in the manner of common spray devices. The tank 27 can be inserted into the casing 4 in such a way that it fills the space between the liquid dispenser tank 6 and the side wall 18, after closing the casing 4, whereby the push button 28 with the nozzle opening 28' extends to the outside through an opening 30 on the front 15 of the casing. The tank 27, which has a closable refill opening 29 on the top and a handle 31 on the back, is pressed against the back wall 2 when the casing is closed, so that spraying of the fragrance by pressing on the push button 28 is possible.

Figure 4:
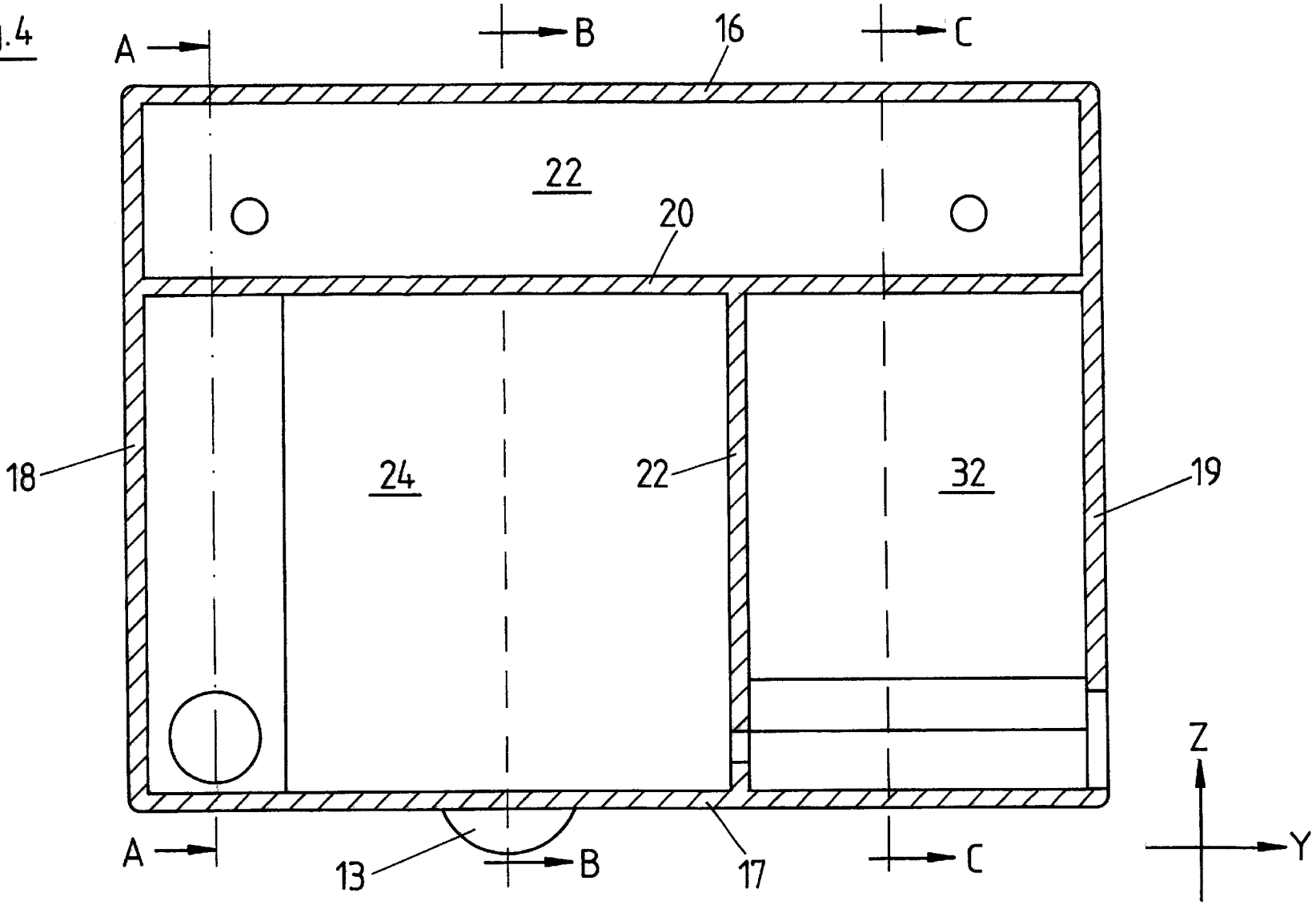
FIG. 4 a simplified depiction of a cross section through the dispenser of FIG. 1 in a vertical plane FIG. 5 a cross section corresponding to the line B—B of FIG. 4.
Figure 7:
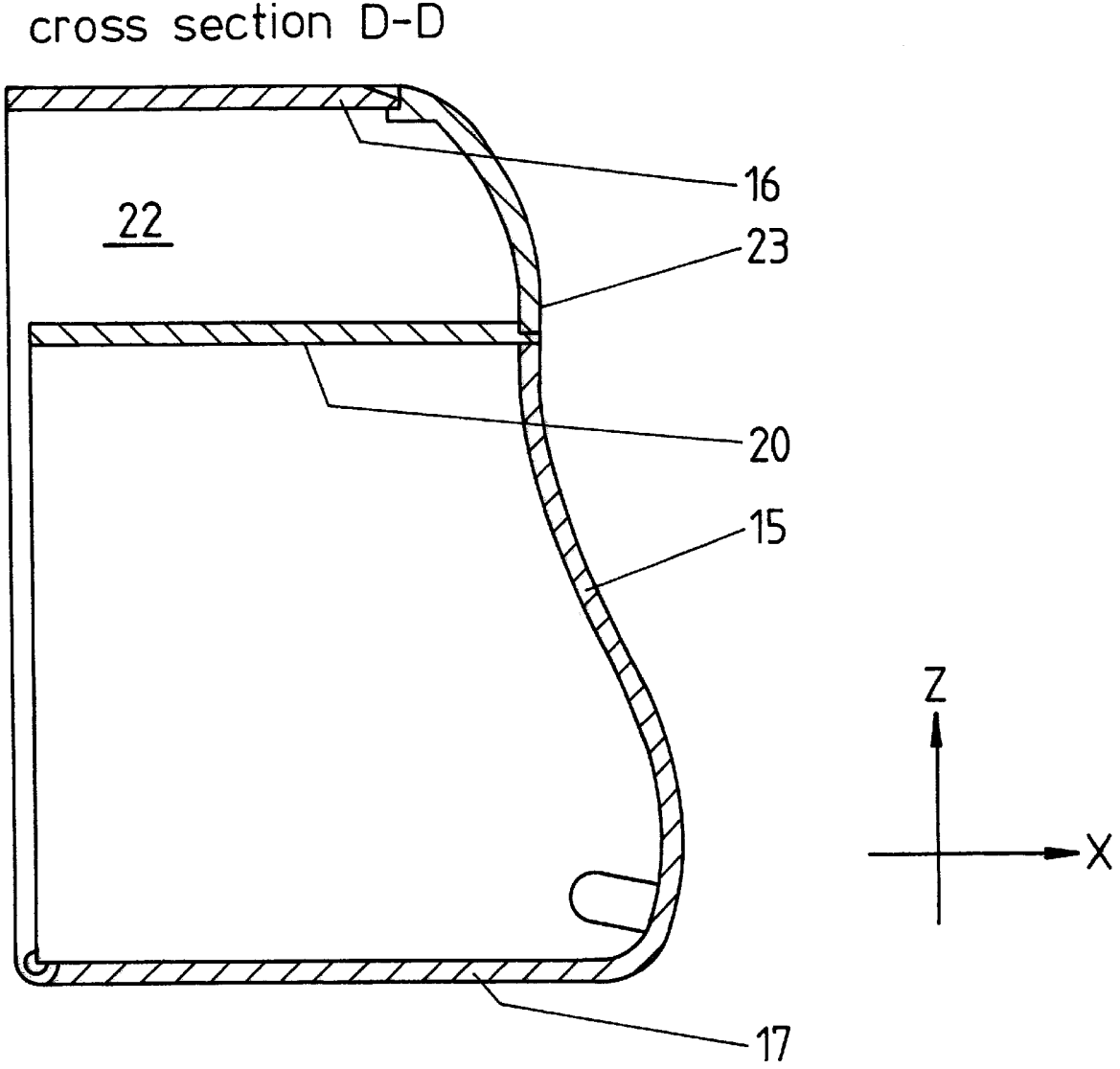
FIG. 7 a depiction similar to FIG. 5, however with the tank of the liquid dispenser removed from the casing of the dispenser FIG. 8 a back view of the hinged casing element of the dispenser of FIG. 1.
Figure 8:
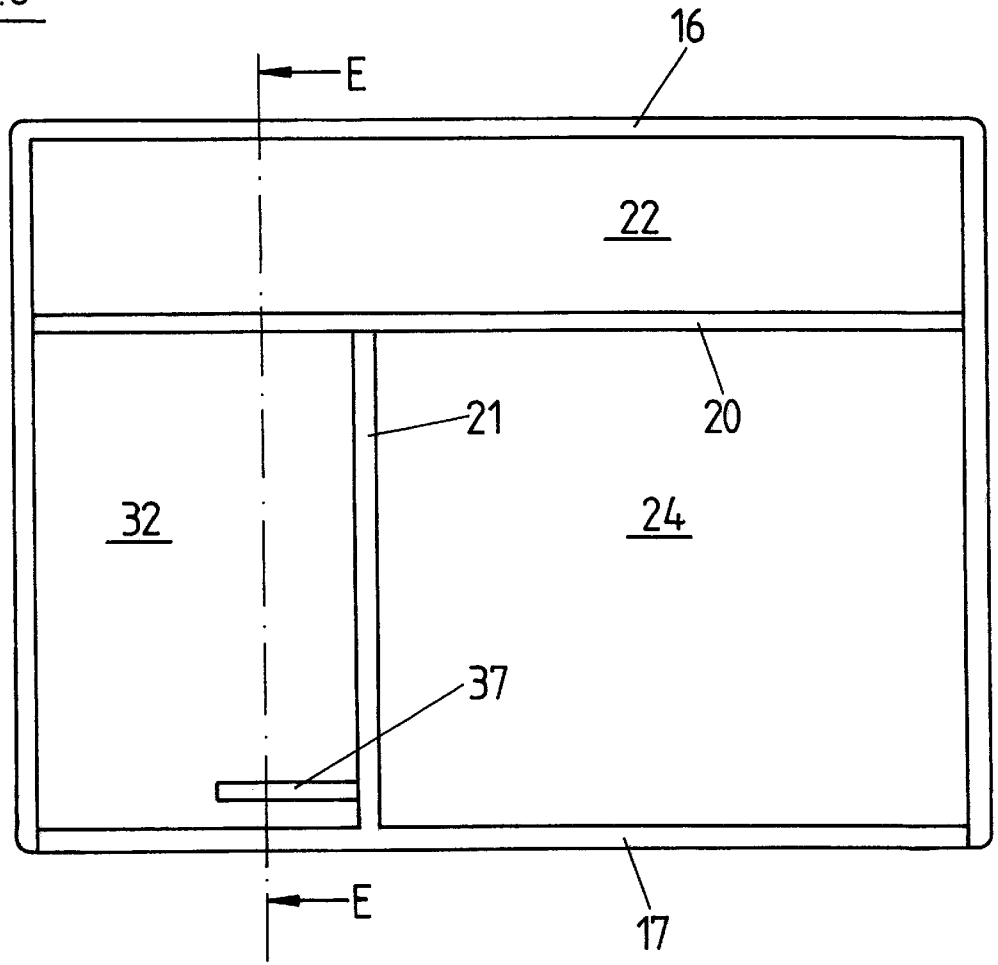
Figure 9:
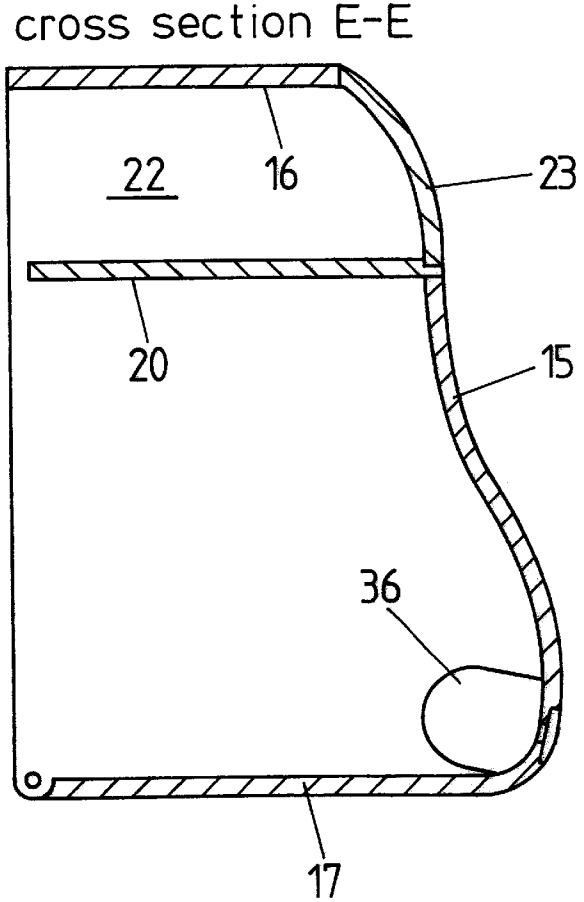
FIG. 9 a cross section corresponding to the line E—E of FIG. 8.

Between the intermediate wall 21 and the right side wall 19, in FIG. 4 another compartment 32 is formed in the casing 4, also open toward the back of this casing. When the casing 4 is closed, the compartment 32 holds a shaft 33 of a tampon dispenser constructed for this purpose. The shaft 33 is located on the back wall 2 and extends from this diagonally downward, with increasing distance from the plane of the back wall 2. The shaft 33 is open at the top end, so that tampons 34 can be filled into this shaft 33, which then lie in the Y-axis with their longitudinal side. The bottom end of the shaft 33 is partially closed, in such a way that the tampons 34 cannot slip out. When the casing 4 is closed the bottom end of the shaft 33 is directly adjacent to the inner surface of the front wall 15, near the crossover to the bottom 17. On the front side 15 there is a slide mechanism 35, which is part of the tampon dispenser and with which the bottommost tampon 35 in the shaft 33 can be pushed out at a dispenser opening on the side 19. For the slide mechanism 35, there is a slot 37 in the front side 15 extending in the Y-axis in which the slide mechanism 35 is guided. Furthermore, the slide mechanism 35 consists of an actuating button 35' accessible on the outside of the casing and of a pusher surface 35" located on the inside, against which the tampon 34 is pressed when being pushed out. The shaft 33 is for example a shaft that is closed on its entire perimeter with a rectangular profile. In principle it is also possible to choose a C-shaped profile for the shaft 33 such that the top of the shaft 33 is open at least in the middle area, so that the fill level of the shaft 33 can be visually checked. Under the shaft 33 there is a depot 38 for holding a supply of tampons 34.

Figure 23:
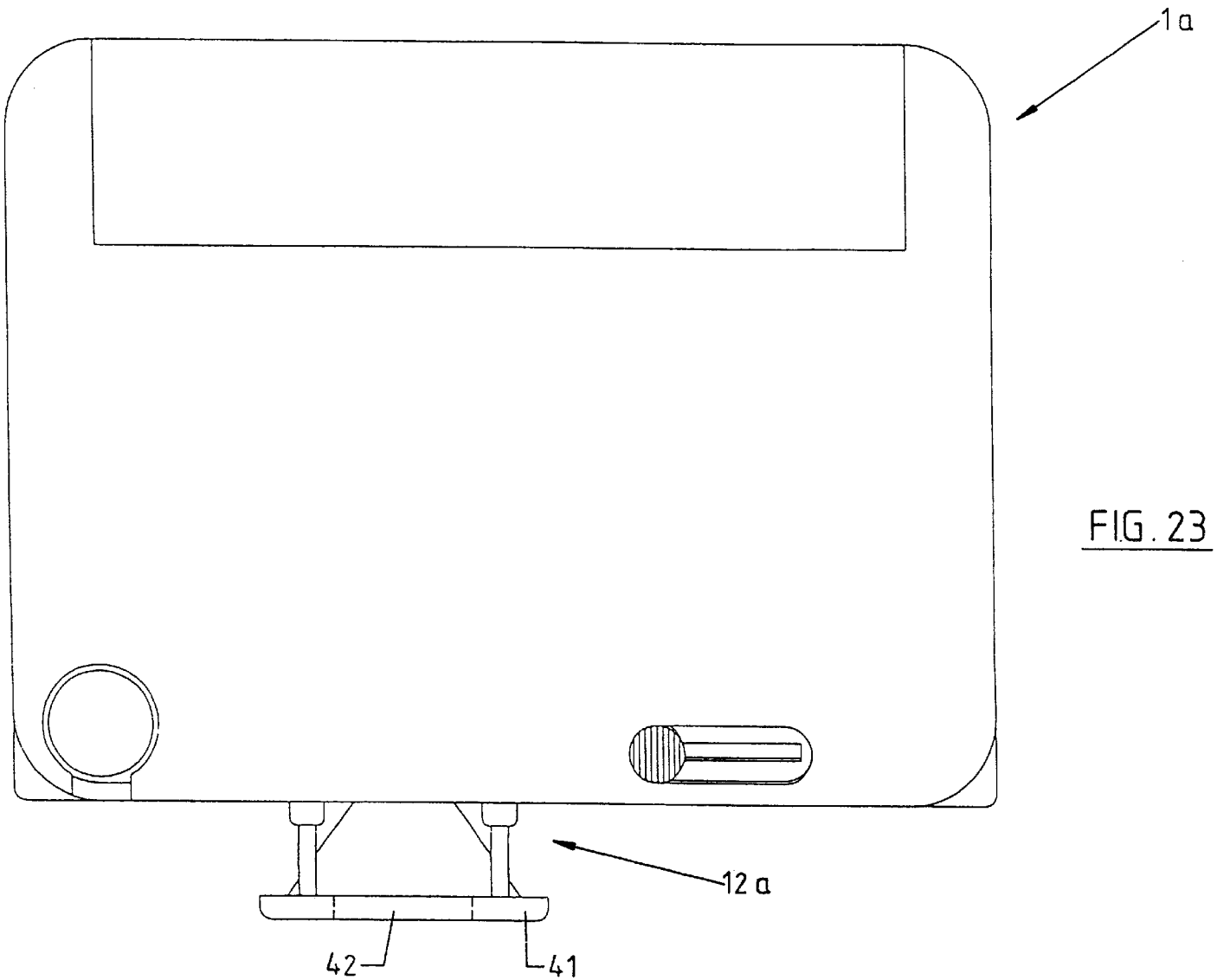
FIGS. 23 and 24 a further embodiment of the restroom dispenser in side view and in cross section.
Figure 24:
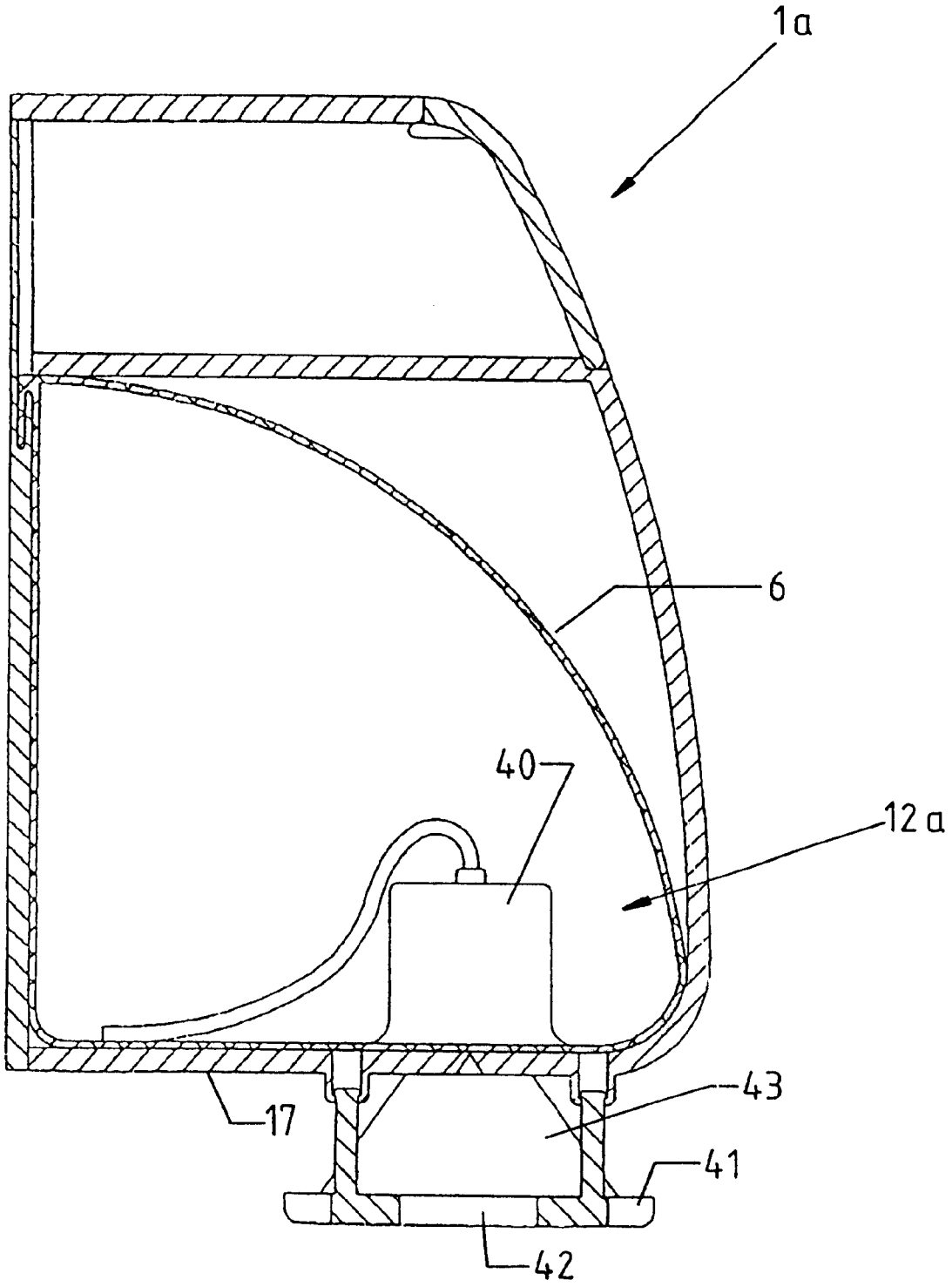

FIGS. 23 and 24 show a dispenser 1*a* that differs from the dispenser 1 of FIGS. 1–22 only in that instead of the dosing element 12 with the ball 13 on the liquid dispenser tank 6, a dosing device 12*a* is provided for that has a dosing or spray pump 40 in the tank 6 with a spray opening on the bottom 17 of the casing and that can be actuated by means of an actuating ring 41 extending past the bottom 17, by lifting this ring with a medium ring opening 42. The spray opening is in a cone 43 that increases toward the bottom, so as to prevent unwanted lateral spraying of the liquid from the liquid dispenser.

The invention has been described above with reference to sample embodiments. Of course, numerous alterations and adaptations are possible without abandoning the underlying inventive idea. Thus it is possible, for example, for the liquid dispenser to have a different dosing system, for example a spray system similar to the spray system of the fragrance dispenser 26.

Furthermore it is possible to integrate a toilet paper roll dispenser in the dispenser 1.

Furthermore it is also possible that the liquid dispenser tank 6 consists of a one-way or disposable package for the respective liquid, whereby the dosing element 12 or 12*a* or an auxiliary tank possessing this dosing element can be connected to this tank by means of a suitable adapter or that the dosing element 12 or 12*a* is part of this disposable package. The disposable package is then designed to be exchangeable in the restroom dispenser 1 or 1*a* or in its casing 4.

LIST OF REFERENCE SYMBOLS

1, 1*a* restroom dispenser
2 back wall
3 building wall
4 casing
5 receptacle
6 liquid dispenser tank
7 fastening element
8 back
9 bottom
10 front
11 refill opening
12, 12*a* dosing element
13 ball
14 spring
15 front of casing
16 top of casing
17 bottom of casing
18, 19 sides of casing
20, 21 intermediate walls of casing
22 compartment
23 hinged cover
24 compartment
25 opening
26 fragrance dispenser
27 fragrance dispenser tank
28 actuating element or push button
28' spray nozzle
29 spray nozzle
30 opening
31 handle
32 compartment
33 shaft
34 tampon
35 slide mechanism
35' actuating surface
35" pusher surface
36 discharge or dispenser opening
37 slot
38 depot
40 dosing pump
41 actuating ring
42 ring opening
43 atomizing cone

What is claimed is:

1. A restroom dispenser comprising a casing, the casing comprising a back wall and having an inner compartment that supports a tank of a liquid dispenser with a dosing apparatus at a bottom of the casing for dispensing a liquid, wherein the casing is swivelled on a vertical axis along the back wall.

2. A restroom dispenser comprising a casing, the casing comprising a back wall and havening an inner compartment that supports a tank of a liquid dispenser with a dosing apparatus at a bottom of the casing for dispensing a liquid, and further comprising a tampon dispensing device in a compartment of the casing, the tampon dispensing device consists of a shaft for holding a plurality of tampons and at least one dispenser slide mechanism on an open end of the shaft.

3. A restroom dispenser comprising a casing, the casing comprising a back wall and having an inner compartment that supports a tank of a liquid dispenser with a dosing apparatus at a bottom of the casing for dispensing a liquid, said dispenser being a fragranced dispenser in a compartment of the casing, the fragranced dispensing having an actuator bottom accessible on an outer surface of the casing and a sprayer device on the fragrance dispenser located on a tank of the fragrance dispenser.

4. A restroom dispenser comprising a casing, the casing comprising a back wall and having an inner compartment that supports a tank of a liquid dispenser with a dosing apparatus at a bottom of the casing for dispensing a liquid wherein the dosing apparatus comprising a pump and a dosing aperture connected to an outlet of the pump, the pump being actuated by a means for actuating the pump on a bottom of the casing, wherein the means for actuating is a ring-shaped actuating element.

5. The restroom dispenser of claim 1, wherein the casing has a hood shaped section and the hook shaped section is movable away from the back wall for opening the restroom dispenser and wherein means for fastening the tank in the inner compartment is located on the back wall.

6. The restroom dispenser of claim 1, wherein the dosing apparatus of the liquid dispenser consists of a roller with a ball.

7. The restroom dispenser of claim 1, further comprising a tampon dispensing device in a compartment of the casing, the tampon dispensing device consists of a shaft for holding a plurality of tampons and at least one dispenser slide mechanism on an open bottom end of the shaft.

8. The restroom dispenser of claim 1, further comprising a fragrance dispenser in a compartment of the casing, the fragrance dispenser having an actuator button accessible on an outer surface of the casing and a sprayer device on the fragrance dispenser located on a tank of the fragrance dispenser.

9. The restroom dispenser of claim 1, further comprising at least one compartment in the casing for holding objects, wherein the at least one compartment has a hinged cover on a front side of the casing.

10. The restroom dispenser of claim 1, wherein the dosing apparatus comprises a dosing pump and a dosing aperture connected to an outlet of the pump, whereby the pump is actuated by a means for actuating the pump on a bottom of the casing.

11. The restroom dispenser of claim 1, wherein the tank of the liquid dispenser is removable and disposable.

12. The restroom dispenser of claim 3, wherein the casing is swivelled on a vertical axis along the back Wall.

* * * * *